US010640314B2

(12) United States Patent
Gentil

(10) Patent No.: US 10,640,314 B2
(45) Date of Patent: May 5, 2020

(54) DETECTION SYSTEM FOR DETECTING DOUBLE SHEETS IN A SHEET ELEMENT PROCESSING MACHINE, AND SHEET ELEMENT PROCESSING MACHINE

(71) Applicant: BOBST MEX SA, Mex (CH)

(72) Inventor: David Guillaume Gentil, L'Auberson (CH)

(73) Assignee: BOBST MEX SA (CH)

( * ) Notice: Subject to any disclaimer, the term of this patent is extended or adjusted under 35 U.S.C. 154(b) by 2 days.

(21) Appl. No.: 16/301,495

(22) PCT Filed: May 10, 2017

(86) PCT No.: PCT/EP2017/025116

§ 371 (c)(1),
(2) Date: Nov. 14, 2018

(87) PCT Pub. No.: WO2017/207111

PCT Pub. Date: Dec. 7, 2017

(65) Prior Publication Data

US 2019/0283996 A1 Sep. 19, 2019

(30) Foreign Application Priority Data

May 30, 2016 (DE) ..... 10 2016 109 920

(51) Int. Cl.
*B65H 7/12* (2006.01)
*B65H 9/10* (2006.01)

(52) U.S. Cl.
CPC ..... *B65H 7/12* (2013.01); *B65H 9/101* (2013.01); *B65H 9/106* (2013.01);
(Continued)

(58) Field of Classification Search
CPC ..... B65H 7/12; B65H 9/101; B65H 9/106; B65H 2403/51; B65H 2511/22;
(Continued)

(56) References Cited

U.S. PATENT DOCUMENTS 5,203,555 A 4/1993 Cannaverde et al. ..... 271/263

FOREIGN PATENT DOCUMENTS

EP 0 669 274 A1 8/1995
EP 2 657 165 A2 10/2013
(Continued)

OTHER PUBLICATIONS

International Search Report dated Aug. 29, 2017 in corresponding PCT International Application No. PCT/EP2017/025116.
(Continued)

*Primary Examiner* — David H Bollinger
(74) *Attorney, Agent, or Firm* — Ostrolenk Faber LLP

(57) ABSTRACT

A detection system for detecting double sheets being supplied to a lateral positioning device (100) for a sheet element (20, 20') in a sheet element processing machine. The machine has a drive system including a cam disk (174) and a cam follower lever (172). The detection system includes a detector lever (130) mounted so as to be displaceable between a sheet receiving position and a detection position. The detector lever (130) has a sheet sensing end (132) for engagement with an upper face of the sheet element (20, 20') when being in the detection position, and a position detector end (133) for cooperating, when being in the detection position, with a position detector (140) adapted for generating a signal dependent on the thickness of the sheet element (20, 20'), and further includes a raising lever (170) for raising the sheet sensing end (132) of the detector lever (130). The raising lever (170) is mounted on the cam follower lever (172) of the sheet element processing machine. Further disclosed is a sheet element processing machine including a detection system as outlined above, mounted in an introduction station (10) upstream of a processing station.

15 Claims, 9 Drawing Sheets

(52) U.S. Cl.
CPC ..... *B65H 2403/51* (2013.01); *B65H 2511/13* (2013.01); *B65H 2511/22* (2013.01); *B65H 2511/524* (2013.01); *B65H 2553/24* (2013.01); *B65H 2553/612* (2013.01)

(58) Field of Classification Search
CPC ..... B65H 2511/524; B65H 2553/24; B65H 2553/612; B65H 2220/03; B65H 2220/01
USPC ..... 271/262, 263, 265.04
See application file for complete search history.

(56) References Cited

FOREIGN PATENT DOCUMENTS

| | | | |
|---|---|---|---|
| JP | S60-47751 | U | 4/1985 |
| JP | H04-30203 | Y2 | 7/1992 |
| JP | 3426850 | B2 | 7/2003 |
| WO | WO 2016/062411 | A1 | 4/2016 |

OTHER PUBLICATIONS

Written Opinion dated Aug. 29, 2017 in corresponding PCT International Application No. PCT/EP2017/025116.

DETECTION SYSTEM FOR DETECTING DOUBLE SHEETS IN A SHEET ELEMENT PROCESSING MACHINE, AND SHEET ELEMENT PROCESSING MACHINE

CROSS-REFERENCE TO RELATED APPLICATIONS

The present application is a 35 U.S.C. §§ 371 national phase conversion of PCT/EP2017/025116, filed May 10, 2017, which claims priority of German Patent Application No. 10 2016 109 920.1, filed May 30, 2016, the contents of which are incorporated by reference herein. The PCT International Application was published in the English language.

TECHNICAL FIELD

The invention relates to a detection system for detecting double sheets being supplied to a lateral positioning device for a sheet element in a sheet element processing machine, and to a sheet element processing machine.

TECHNICAL BACKGROUND

Sheet element processing machines typically comprise an introduction station where sheets (usually paper sheets and/or cardboard sheets) are provided to a feed table. The feed table is situated upstream of a cutting machine or a platen press. The sheet element is advanced against one or more front tabs by first means such as endless belts or rollers, then delivered by second means against one or more lateral positioning tabs before the front edge of the sheet element is gripped by a series of grippers mounted on a gripper bar arranged on a chain system.

Such a device is used for precise lateral positioning of sheet elements which have already undergone one or more printing operations, wherein the subsequent operation may be either a stamping process, for example hot foil stamping in a platen press, or a cutting and waste discharge operation in such a press. This subsequent operation must be performed in strict accordance with the preceding printing.

Lateral positioning devices are today used for jogging the sheets. They comprise firstly a lower roller driven in rotation and arranged transversely to the direction of movement of a sheet, close to a lateral tab situated on the left side of the table as viewed also in the direction of movement of the sheet, which is normally known as the operators side. However there are two lateral positioning devices on a machine, one on the operator side and one on the opposite operator side. The operator is free to work with one or the other depending on the requirements of the layout of the final product. These devices then comprise an upper roller, vertically above the lower roller, and mounted at the end of an arm which is in the top position at rest. This arm is lowered regularly on arrival of a sheet element against the frontal tabs, such that the upper roller grips the sheet element against the lower motorized roller which, by traction on the sheet element, causes a correction movement of the sheet element as far as the lateral tab.

There are different approaches in the prior art for detecting an unwanted condition in which sheets are not supplied individually but in a superimposed condition.

Document EP 0669274 describes a lateral positioning device for a sheet element on a feed table, with elements for holding the sheet element (by traction or thrust) with extended surfaces. The aim is thus to avoid damaging the grip surfaces of the sheet element. The singularity of the sheet element engaging in the lateral positioning device is here verified by a complementary device, situated at the inlet to the positioning device and comprising an upper roller and a lower roller situated in the same vertical plane. The spacing of these rollers is set to the value of the thickness of a single sheet element.

Document JP 3426850 describes a positioning device wherein the sheet element is moved laterally in one or the other transverse direction by means of a guidance device comprising two pairs of upper and lower rollers situated in the same vertical plane, each mounted on different lateral sides of the device. Each pair of rollers may be disengaged and the direction of rotation of the rollers may be reversed in order to allow driving of the sheet element in the required direction to correct its positioning. However, this method of gripping tends to mark sheet elements of the corrugated cardboard type, which are more susceptible to crushing than is flat cardboard.

Document JPS 6047751U describes a device with a pivoting lever arm carrying, at its end directed towards the sheet element, a freely rotating roller situated above a drive wheel which is continuously rotated by an endless screw, in order to take the sheet element assembly and deliver it by traction against the lateral stop. The roller of the pivoting lever may be moved away or retracted to switch from the pull mode of moving the sheet element to the push mode of moving the sheet element.

Document JPH 0430203 (JPS62147642) describes a positioning device in which the sheet element is moved laterally in the one or the other transverse direction by means of a guidance device comprising a pair of upper and lower rollers situated in the same vertical plane. The upper roller is freely rotatably mounted, and the direction of rotation of the lower roller may be reversed to allow driving of the sheet element in the required direction in order to correct its positioning. The same guidance device is present on each lateral side of the positioning station.

SUMMARY OF THE INVENTION

The object of the invention is to propose a detection system which allows reliably detecting superimposed sheets while at the same time having a simple and economic design.

In order to achieve this object, the invention provides a detection system for detecting double sheets being supplied to a lateral positioning device for a sheet element in a sheet element processing machine. The sheet element processing machine has a drive system including a cam and a cam follower lever. The detection system comprises a detector lever mounted so as to be displaceable between a sheet receiving position and a detection position. The detector lever has a sheet sensing end for engagement with an upper surface of the sheet element when the detector lever is in the detection position, and has a position detector end for cooperating, when the detector lever is in the detection position, and has a position detector configured for generating a signal dependent on the thickness of the sheet element. The detector system further comprises a raising lever configured for raising the sheet sensing end of the detector lever. The raising lever is mounted on the cam follower lever of the sheet element processing machine. To achieve the above mentioned object, a sheet element processing machine comprises a detection system outlined above and mounted in an introduction station upstream of a processing station.

This detection system and the sheet element processing machine equipped with that system allow achieving a couple of advantages. First, it is mechanically simple, so that it can be implemented at low costs. Second, it is space-saving, so that it can be used in existing printing environments without many modifications to existing printing machines. Third, it allows reliable detection of the height of the sheet(s) present under the sheet sensing end of the detector lever.

Detection of a double thickness allows indication of the abnormal presence of two superposed sheet elements. More generally, the object is to propose a device which is able to detect an abnormally great thickness of the sheet element in order to identify the abnormal presence of more than one sheet element. In fact, despite the care taken upstream to ensure that the sheet elements arrive one by one, a pair of superposed sheet elements may be delivered instead of a single sheet element, in particular because of electrostatic forces which may be present between the facing sides of two superposed sheet elements.

Such detection allows the operation of the processing machine to be stopped before any jamming occurs, in order to extract the superfluous sheet element in the presence of a superposed pair of sheet elements, or more generally to extract any arrangement of sheet elements which does not conform to the expected thickness. This allows rapid resumption of operation of the machine. In this way, the machine stoppage time has been reduced to a minimum, which is advantageous in terms of machine efficiency.

Preferably, the raising lever cooperates with the detector lever by abutting at a raising abutment provided on the detector lever. It has been found that this mechanically simple way of coupling the raising lever to the detector lever leads to a reproducible actuation of the detector lever.

According to a preferred embodiment, a tangent to the raising abutment, at the point of contact of the raising lever, is inclined with respect to a line running through the pivot axis of the cam follower lever and the point of contact, at an angle which is between 30° and 80° and more preferably in the order of 10° to 30°. The angle of inclination allows setting the vertical speed of the sheet sensing end of the detector lever, resulting from a raising movement of the cooperating end of the raising lever, to a desired value in a mechanically very simple manner. In particular, the speed of movement of the detector lever can be set to values which are lower than the speed of movement of the raising lever.

Preferably, the raising lever cooperates with the raising abutment by means of a roller. This reduces friction in the detection system.

In order to assure that the sheet sensing end of the detector lever reliably comes into contact with the sheet(s) to be detected, a clearance is present between the raising lever and the detector lever when the detector lever is in the detection position.

Preferably, the position detector end of the detector lever is equipped with a metal target which cooperates with a detection head of the position detector fitted with an inductive proximity sensor. This design avoids any intermediate elements so that the position detector directly cooperates with the detector lever.

For ensuring in a mechanically simple manner that the detector lever is biased into the detection position, a return spring is provided for biasing the detector lever into the detection position.

The invention will be better understood and its various advantages and characteristics will arise more clearly from the description below of the non-limitative exemplary embodiment, with reference to the attached drawings. In the drawings,

DESCRIPTION OF AN EMBODIMENT

The detector system for detecting two superimposed sheets of cardboard, paper or similar material used in printing operations is implemented as part of a sheet element processing machine and in particular as part of a lateral positioning device for a sheet element. The lateral positioning device will be described with reference to FIGS. 1 to 8, and the detector system will then be described with reference to FIGS. 10 to 14.

Figure 5:
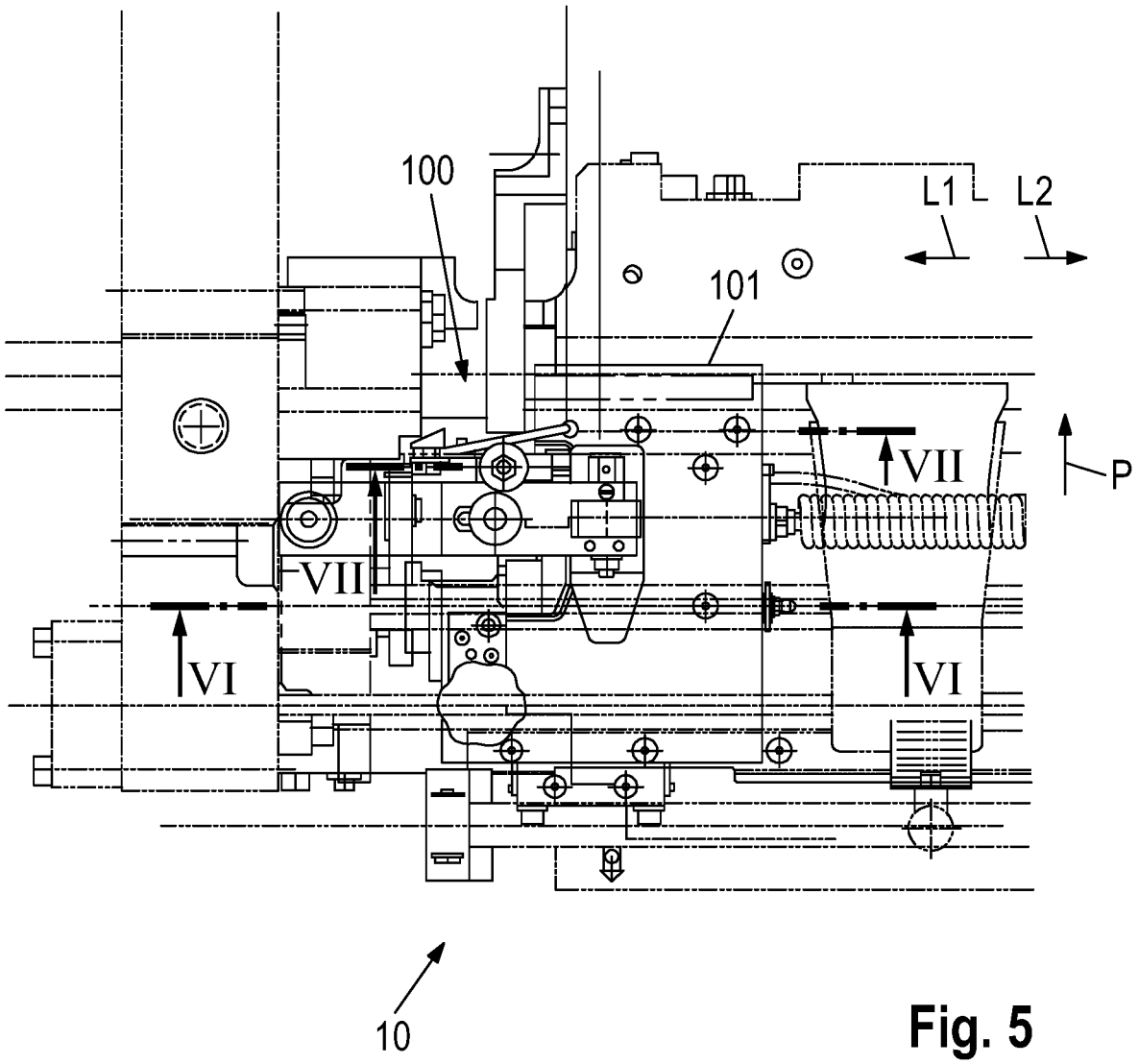
FIG. 5 is a partial view from above of a feed table of the sheet element processing machine of FIGS. 1 to 4.

In the present text, the term "lateral" designates a direction perpendicular to the direction of advance of sheet elements, such as paper sheets, in a processing machine, and in particular in an introduction station 10 partly visible FIG. 5. Arrow P designates the direction of advance of the sheets to be processed from upstream to downstream, arrow L1 designates the left lateral side or OS for "Operator Side", and arrow L2 designates the right lateral side, or OOS for "Opposite Operator Side".

The lateral positioning device 100 in FIG. 5 is in this example located on the operators side and is intended to ensure good lateral positioning of a sheet element, such as a sheet of printed cardboard, before its processing, such as cutting by platen, while the good longitudinal positioning (in direction A) is ensured by a front positioning device (not shown).

Figure 1:
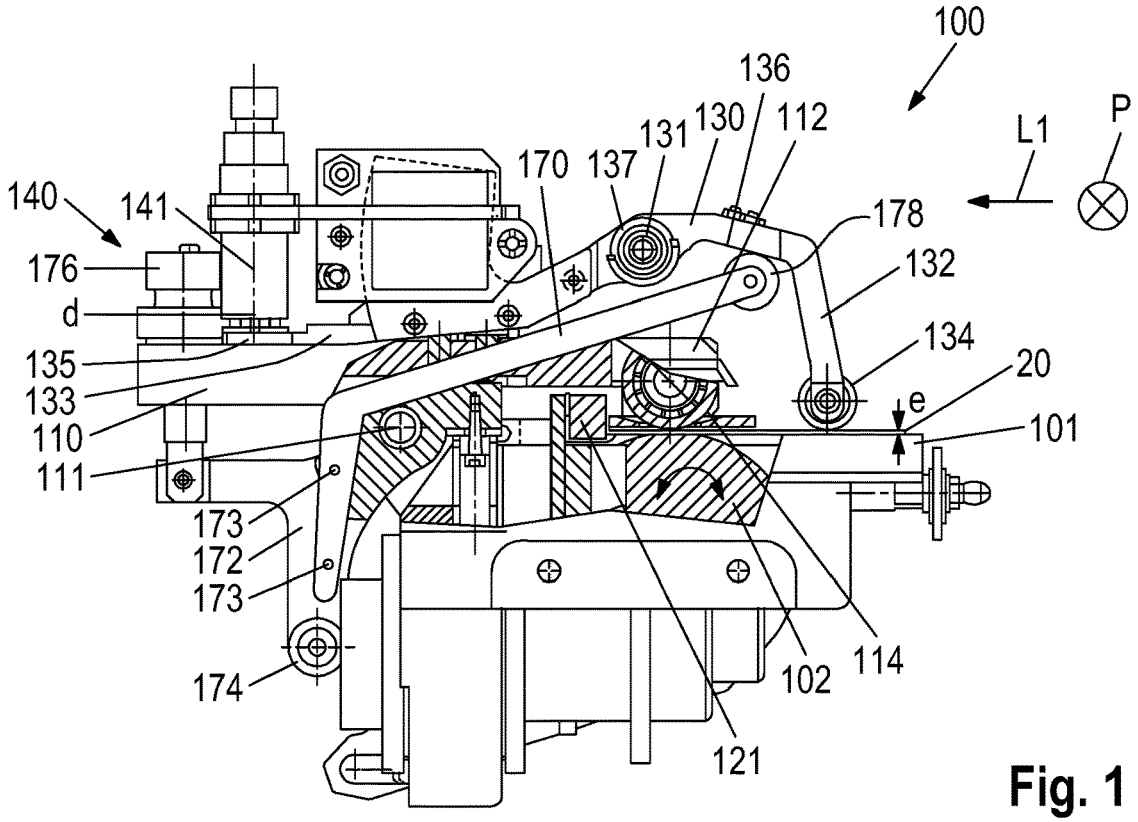
FIG. 1 illustrates in side view, partly in cross section, a sheet element processing machine according to the invention in a first configuration, with the first end of the main lever lowered and the detection system according to the invention being shown schematically.
Figure 2:
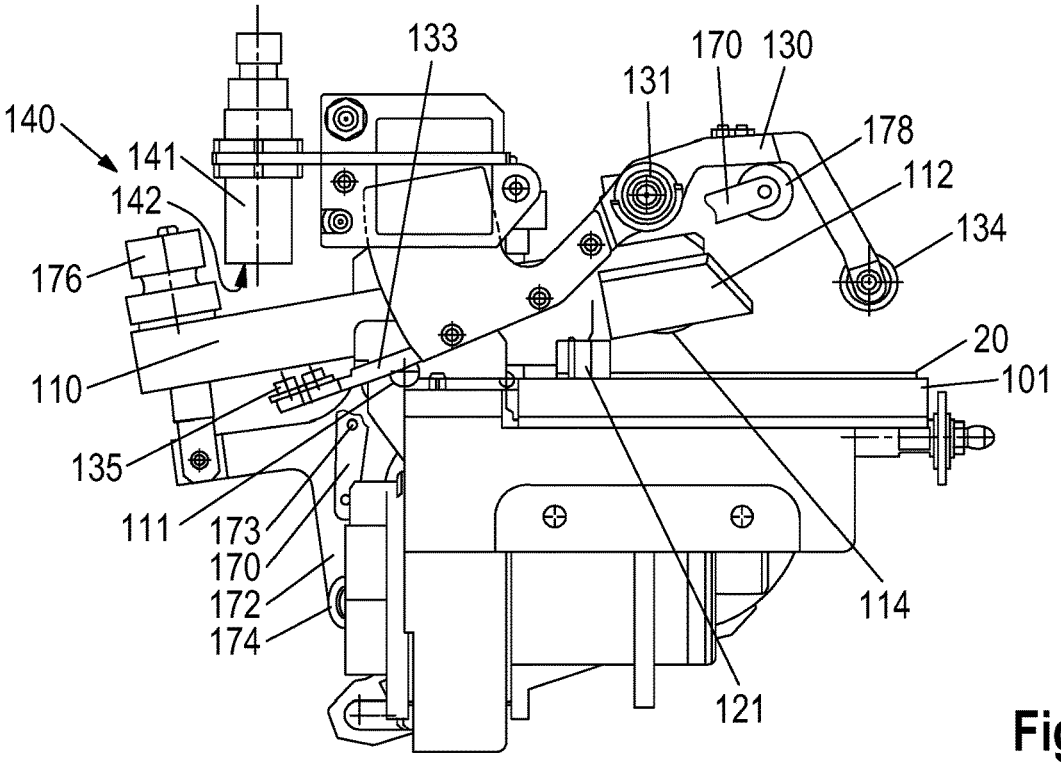
FIG. 2 is a side view of the sheet element processing machine of FIG. 1 in the first configuration, with the first end of the main lever raised.

The operating principle of the lateral positioning device 100 is explained in relation to FIGS. 1 to 4 in which the lateral positioning device 100 is viewed from upstream. A delivery wheel 102 which turns i.e. oscillates rhythmically alternately clockwise and counterclockwise forms the drive means for introducing a sheet element 20. In FIGS. 1 and 2, the lateral positioning device 100 is in the first configuration, where it is able to perform the lateral adjustment of a sheet element 20 which may be of widely varying thickness, in particular between a minimum value for paper with 70 g/m$^2$ and a maximum of 4 mm for corrugated cardboard. Conventionally, this a flat printed cardboard with a multitude of subassemblies, which will be precut in the next unit to form cardboard flaps which, after assembly, will constitute the packaging.

In FIG. 1, the sheet element 20 rests on a support surface front abutment 101. The abutment has a window at the position of the delivery wheel 102, to allow the wheel's periphery to come into contact with the lower face of the sheet in order to drive the sheet from the lateral side L1 using the delivery wheel 102. In this configuration, only the OS side lay is working; the OOS side lay is disabled. A main lever 110 mounted rotatably around direction P on its pivot 111 of horizontal axis, at its first end 112 (on the right in FIGS. 1 to 4 and 6) has a support roller 114, here shown in the form of a roller bearing, placed above the receiver support. Here the main lever 110 is articulated around a horizontal axis. On swiveling of the main lever 110 in the direction of lowering of the first end 112, the arrangement allows the support roller 114 to be aligned with the delivery wheel 102 (see FIGS. 1 and 3) with the two axes of rotation of the support roller 114 and delivery wheel 102 parallel. More precisely, in the low position of the first end 112, the rotation axis of the support roller 114 is aligned with the rotation axis of the delivery wheel 102, as shown In FIG. 1, while the high position of the first end 112 is visible in FIG. 2.

In FIG. 1, in the low position of the first end 112, a slight downward back-pressure is applied by the support roller 114 so as to lightly grip the sheet 20 between the delivery wheel 102 and the support roller 114, and by this gripping of sheet 20 ensures its transfer in the direction of the rotation movement of the delivery wheel 102, which is now counterclockwise, until it comes to rest with its lateral edge against the lateral feed stop 121 facing the delivery wheel 102. In this position, the sheet 20 is arranged laterally in the desired position. The low position of the first end 112 is given by the thickness of the sheet 20, and the strength to grip the sheet is adjusted with the screw 176 in order to have enough strength to pull the sheet but not too much strength so the sheet does not become deteriorated. The strength of gripping is given by a spring placed between lever 110 and cam lever 172. The cam lever 172 is driven by an electric motor and cams, allowing its pivoting with a cadenced rise and fall following the machine cycle for each packaging element 20. Therefore, the lever 110 is driven through cam lever 172 with a device of overstrike given by the spring.

Thus, in the first configuration, the lateral positioning device 100 functions in pull mode, since the sheet is wedged in the desired lateral position by pulling the packaging element 20, gripping and advancing it between the support roller 114 and the delivery wheel 102 until the packaging element 20 comes to rest against the lateral feed stop 121.

The cam lever drives the main lever 110 in parallel, as explained above and the detector lever through the complementary part 170. This configuration gives a cadenced movement to both levers with approximately the same rhythm.

Further, a secondary detector lever 130 is situated next to and upstream of the main lever 110 relative to the direction of advance P of the sheet elements 20. The detector lever 130 swivels around the direction P on its pivot 131 of horizontal axis, and at its first end 132 (at the right in FIGS. 1 to 4 and 6 and also referred to as "sheet sensing end") has a detector roller 134 formed by an idler wheel placed above the support surface 101.

The detector lever 130 can swivel between a sheet receiving position and a detection position. In the detection position, the first end 132 of the detector lever 130 has descended in order to enable the detector roller 134 to come to rest precisely against the upper face of the sheet 20, as shown in FIG. 1. In this position, the second end 133 of the detector lever 130 is raised. A metal target 135 is arranged on this second end 133. This metal target 135 belongs to a proximity detector 140 which is for example an inductive sensor and is situated below a detection head 141, which is calibrated to measure the distance d between its lower face 142 and the metal target 135. The value d measured when the detector roller 134 touches the sheet 20 allows very precise calculation of the thickness e of this packaging element.

In order to force down the first end 132 of the detector lever 130, the shaft 131 about which the detector lever 130 pivots is surrounded by a pre-stressed coil spring 137. This prestressing also allows generation of a support force guaranteeing the contact of the detector roller 134 on the sheet 20 and hence a correct thickness measurement.

By monitoring the value of the thickness e measured for each new packaging element 20 arriving at the lateral positioning device 100, where necessary, the processing machine can be stopped so that an operator can verify and extract the incorrect sheet 20 or set of sheets 20.

Figure 3:
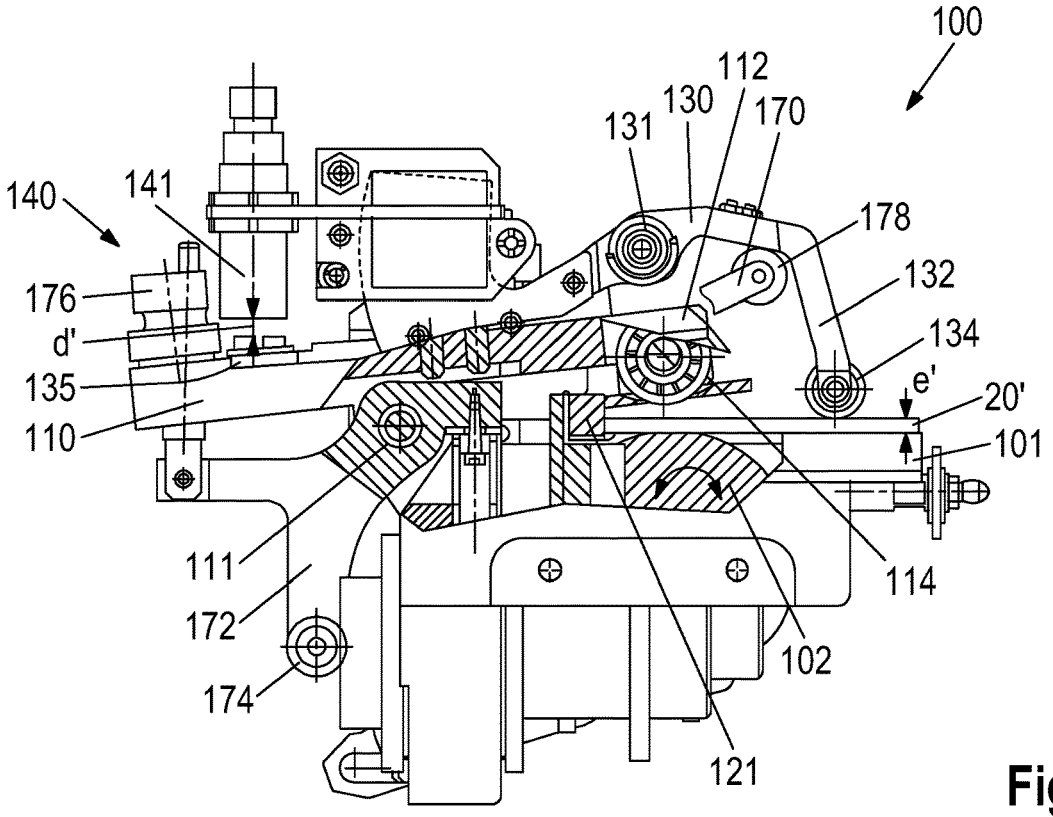
FIG. 3 illustrates in a side view, partly in cross section, the sheet element processing machine of FIG. 1 in a second configuration, with the first end of the main lever lowered.

In FIG. 3, the main lever 110 has been adjusted such that, in the low position of the first end 112, a slight back-pressure is exerted by the support roller 114 on the sheet 20' which is thicker than the sheet 20 of FIGS. 1 and 2.

Figure 4:
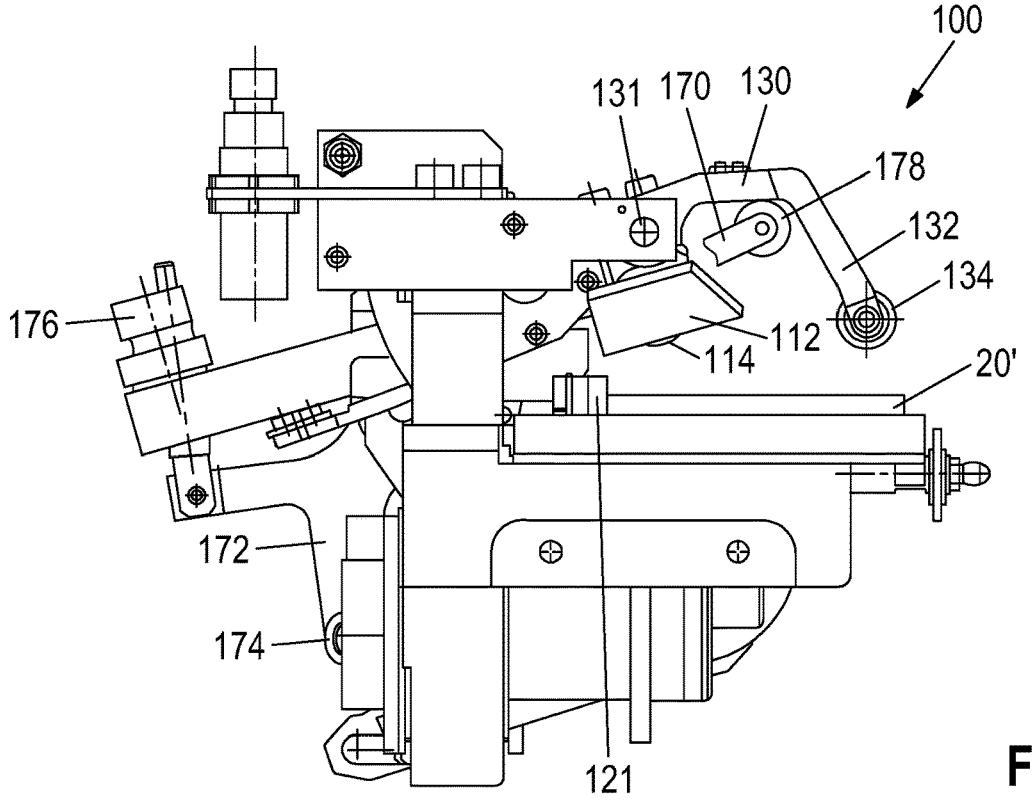
FIG. 4 is a side view of the sheet element processing machine of FIG. 1 in the second configuration, with the first end of the main lever raised.

Also, the lateral positioning device 100 functions in a second configuration shown In FIGS. 3 and 4. In this case, the aim is to avoid pressurized support of the support roller 114 on the sheet 20'. For example because this packaging element 20' has a low density, its surface is easily marked by an imprint under the pressure of a roller. This is the case in particular if the packaging element 20' contains one or more layers of corrugated cardboard. In the example shown, this packaging element 20' has a thickness e' which is greater than the thickness e of the sheet 20 shown in FIGS. 1 and 2. This thickness e' corresponds to a distance d' between the metal target 135 and the detection head 141.

In this second configuration, the support roller 114 is raised relative to its position in the first configuration, so that it is not able to touch the upper surface of the sheet 20' when the first end 112 of the main lever 110 is lowered.

The lateral feed stop acts as a pusher element 121 and is arranged just above the support surface 101 and on the other side of the delivery wheel 102 relative to the support roller 134. This pusher element 121 has a thrust face against which the lateral edge of the sheet 20' comes to rest. This pusher 121 executes a horizontal translation movement (from left to right on FIGS. 3 and 4) from a retracted position, shown in FIGS. 3 and 4, to an advanced position which is set such that at the end of travel, the sheet 20' is arranged laterally in the desired position.

Thus in the second configuration, the lateral positioning device 100 functions in pusher mode, wherein the sheet 20' is wedged in the desired lateral position by pushing this packaging element 20', the pusher 121 is transferred from the retracted position to the advanced position until the packaging element 20' is brought into the lateral position corresponding to the end of travel (advanced position) of the pusher 121.

In this second configuration, the thickness of the sheet present on the feed table is monitored in the same way as described above in relation to the first configuration. To explain the transition from the first configuration (pull mode) to the second configuration (push mode) and vice versa, reference is made to FIGS. 5 to 8.

Figure 6:
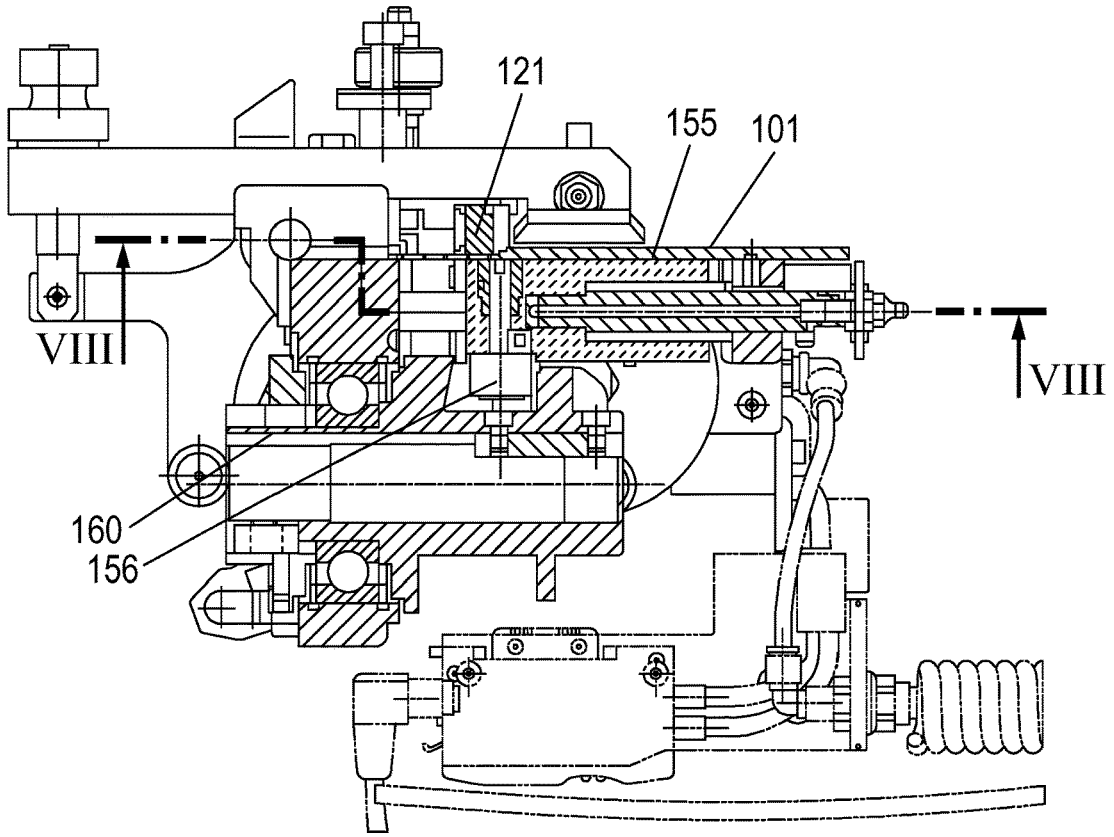
FIG. 6 is a section view in direction VI-VI of FIG. 5.
Figure 7:
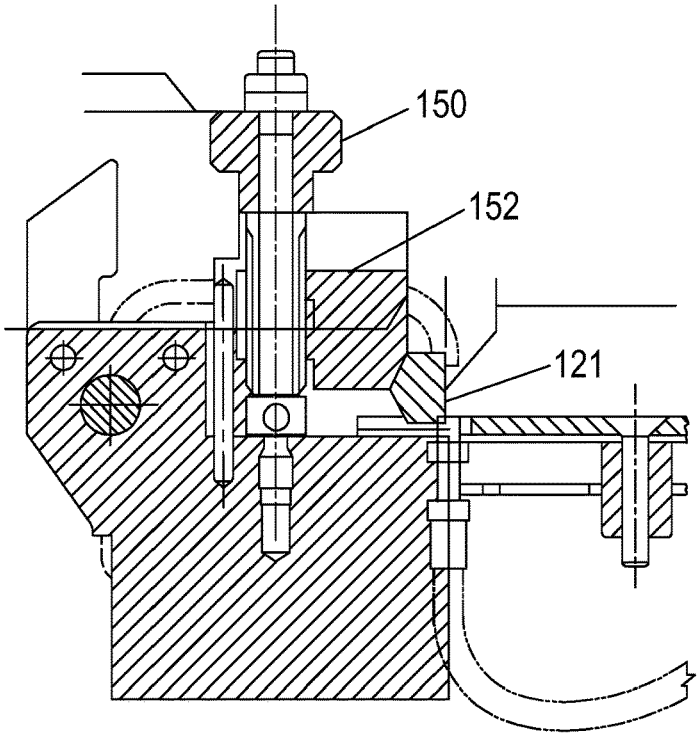
FIG. 7 is a section view in direction VII-VII of FIG. 5.
Figure 8:
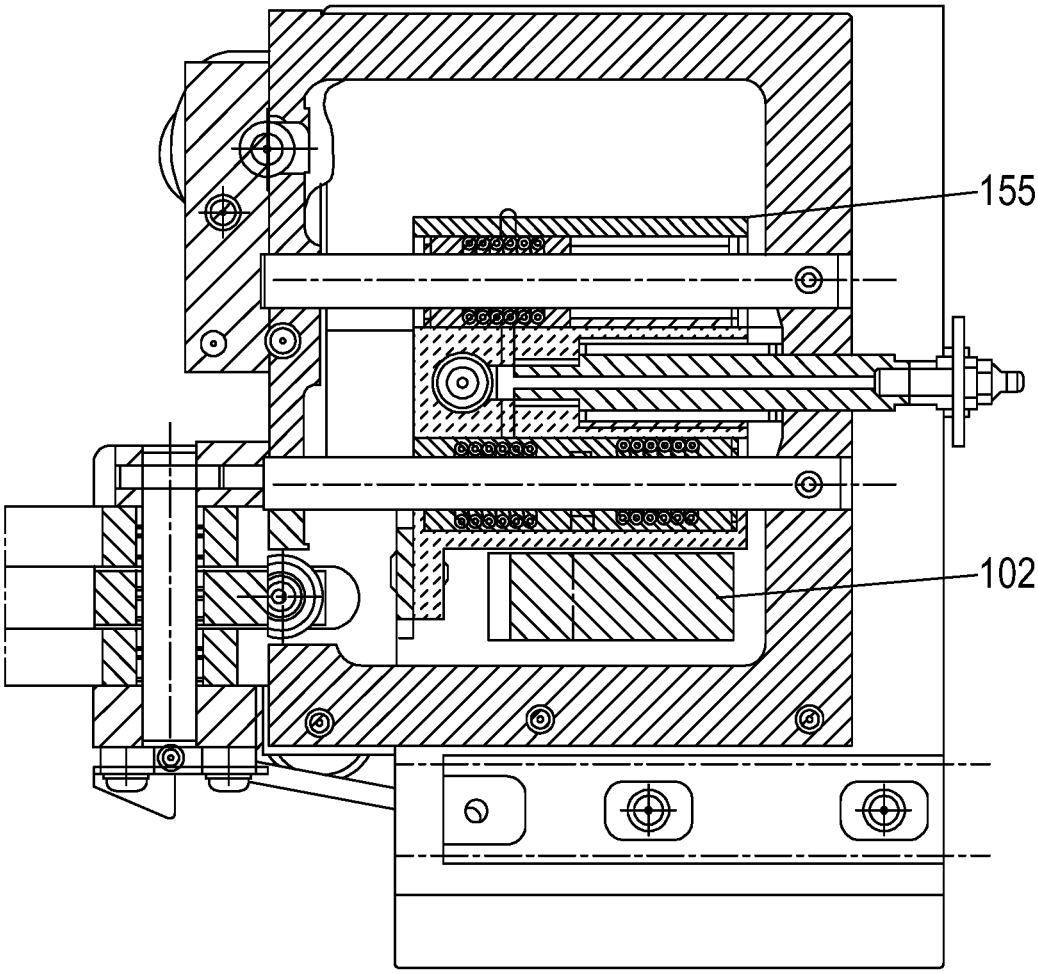
FIG. 8 is a section view in direction VIII-VIII of FIG. 6.

As is shown in FIG. 7, the pusher 121 is blocked in the forward position and serves as a stop for the puller. An adjustment screw 150 allows, by its rotation, the raising or lowering of an adjustment support 152 with a beveled lower edge which cooperates with a beveled upper edge of the block forming both the pusher and the lateral feed stop 121. Thus the descent of the adjustment support 152 causes the pusher 121 to advance in horizontal translation towards the right in FIGS. 6 and 7.

The pusher 121 is fixedly attached to the slider 155, itself fixed to the roller of the cam 156 (see FIG. 6). The position of FIGS. 6 and 7 corresponds to the second abovementioned configuration of the lateral positioning device; in this case, the cam roller 156 is housed in a receiver space for the cam 160, which moves in a permanent cyclic movement, in a position allowing a reciprocating movement of slider 155 between the right and left. This reciprocating movement allows the pusher 121 to perform the positioning of the sheet 20' by pushing. To transfer to the first configuration, the adjustment support 152 is lowered via the adjustment screw 150, causing the pusher 121 to advance towards the right into a position which remains in the receiver space of the cam 160, but this time the pusher 121 is not able to follow the movement of the cam 160 which turns idly because the cam 160 is no longer driving the pusher 121.

Details of the construction and the operation of the detector system are now explained with reference to FIGS. 9 to 14.

Figure 9:
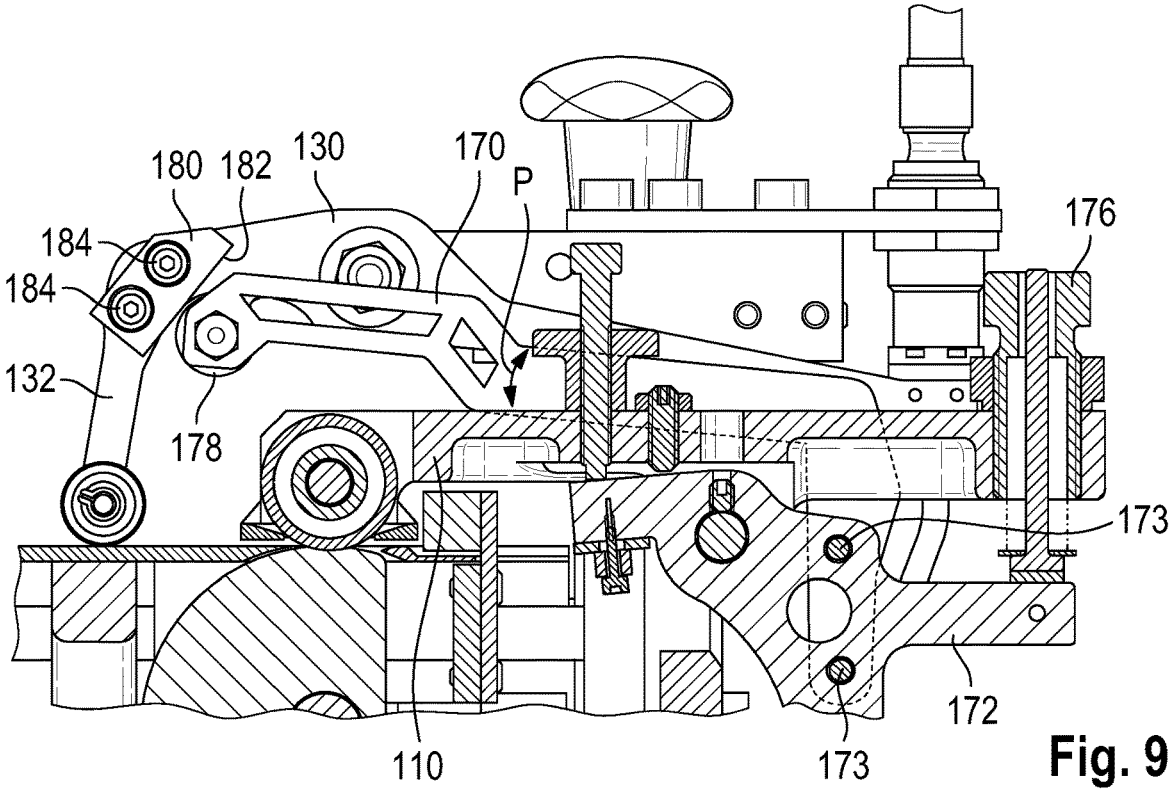
FIG. 9 is a side view of part of the sheet element processing machine according to the invention with the detection system according to the invention shown in more detail.
Figure 14:
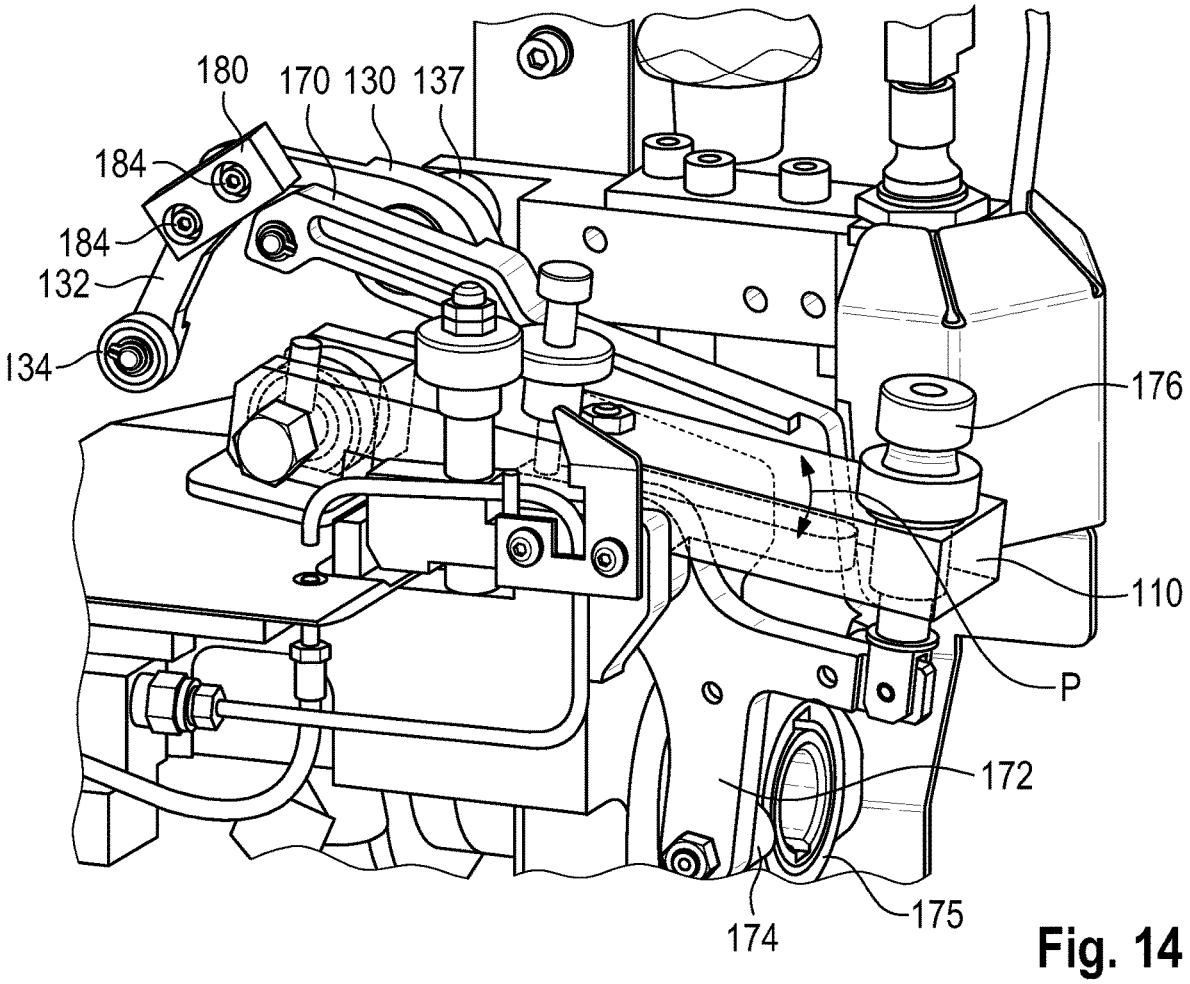
FIG. 14 shows in a perspective view the sheet element processing machine of FIG. 9 with the detector lever being in a sheet receiving position.

The detector lever 130 is pivotable between the sheet sensing position shown in FIG. 9 and the sheet receiving position shown in FIG. 14.

In the sheet sensing position of FIG. 9, the sheet sensing end 132 of detector lever 130 is in a lowered position in which detector roller 134 lies either on the surface of the single sheet present at the lateral feed stop 121 or on the surface of the upper one of two sheets present at the lateral feed stop 121.

In the sheet receiving position of FIG. 14, a sheet (or potentially two superimposed sheets) can be advanced against lateral feed stop 121. As the detector roller 134 is in the sheet receiving position lifted from the table, there is no risk of the detector roller 134 interfering with the advancing movement of the sheet(s) or creating impingement marks at the edge of the sheet(s).

The detector lever 130 is brought from the detection position (against the action of return spring 137) by means of the raising lever 170. The raising lever 170 is a generally rigid arm engaging with one end (referred to in the following as "the raising end") at the detector lever 130 and being mounted with its other end to a cam follower lever 172 (see bolts 173).

Cam follower lever 172 is mounted pivotally on horizontal pivot axis 111 and engages with a cam roller 174 at the surface of a cam disk 175. Cam disk is driven by a motor (not shown) for achieving certain functions of the sheet element processing machine.

Cam follower lever 172 is connected via a spring mechanism 176 to main lever 110. This will not be explained in detail as this is not relevant for understanding the design and the mode of operation of the detection system.

It is only relevant to understand that cam follower lever 172 performs a pivoting movement under the control of the cam disk 175 and that accordingly the raising lever 170 simultaneously performs a pivoting movement as well (see arrow P in FIGS. 9 and 14).

At its raising end, raising lever 170 is provided with a roller 178 which cooperates with detector lever 130. To this end, detector lever 130 is provided with a raising abutment 180 at which roller 178 engages.

Raising abutment 180 is a relatively solid metal block having an outer surface 182 at which roller 178 engages. In the embodiment shown, outer surface 182 is straight.

Raising abutment 180 is connected to detector lever 130 by means of bolts 184 so that it can be easily replaced when necessary. In the exemplary embodiment, the bolts 184 are arranged in recesses, and bushes 186 are being fitted within the bores for the bolts 184 in raising abutment 180 for greater strength.

Figure 10:
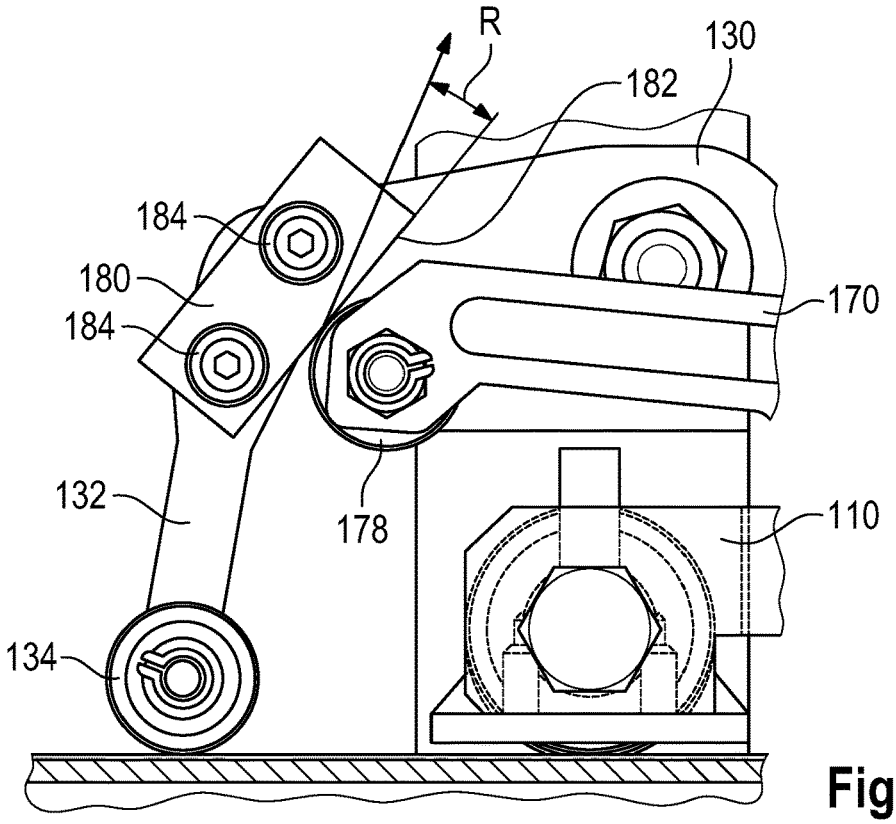
FIG. 10 shows at an enlarged scale the sheet sensing end of the detector lever and the end of the raising lever cooperating with the detector lever; with the sheet sensing end being in a detection position.
Figure 11:
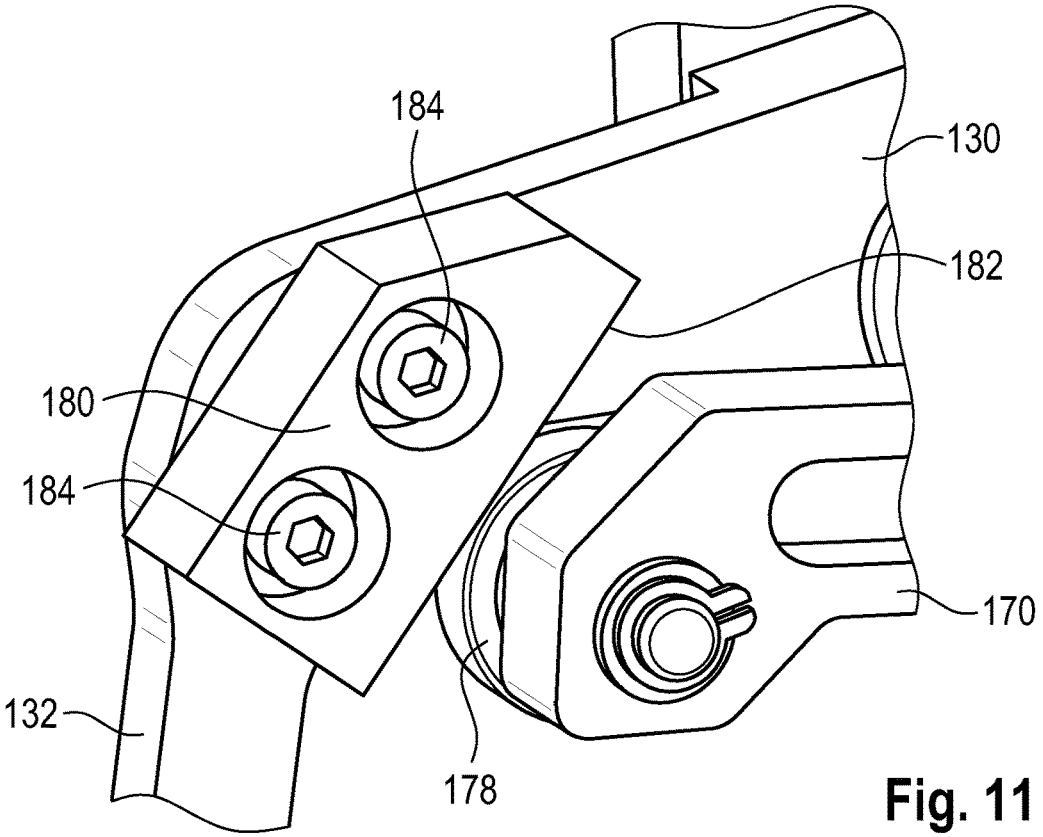
FIG. 11 shows at an enlarged scale and in a perspective view the cooperation between the detector lever and the raising lever.
Figure 12:
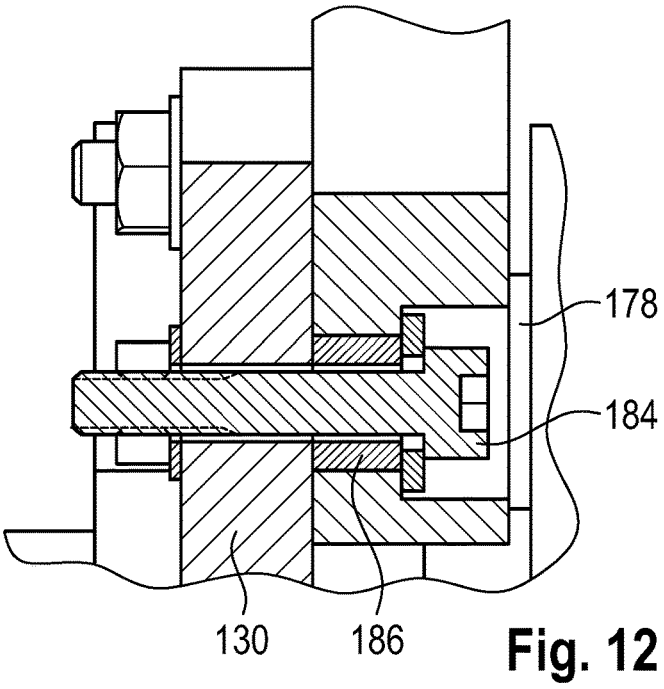
FIG. 12 shows a cross section through the detector lever and the raising abutment provided on the raising lever.
Figure 13:
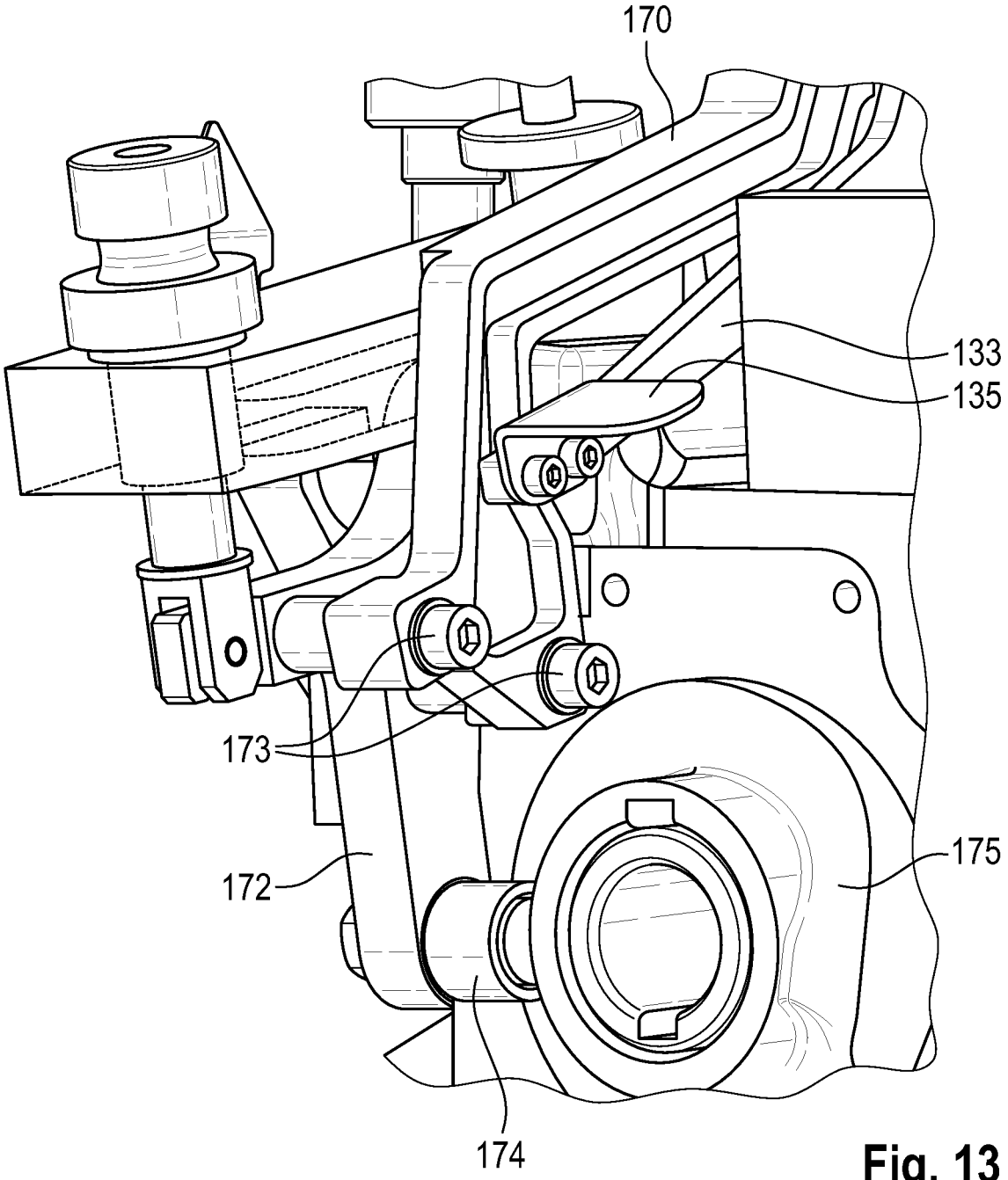
FIG. 13 shows in a perspective view the attachment of the raising lever to the cam follower lever of the sheet element processing machine.

In FIGS. 9 and 10, a small clearance can be seen between the outer surface of roller 178 and surface 182 of raising abutment 180. This clearance ensures that the detector lever 130 can be lowered sufficiently so as to engage on the surface of a sheet regardless of its thickness.

An important feature of the cooperation between the raising lever 170 and the detector lever 130 is the orientation of the outer surface 182 with respect to the direction of movement of the raising end of the raising lever 170.

In FIG. 10, the direction of movement of the raising end of raising lever 170 is shown as arrow R (being oriented perpendicularly to a line running through the point of contact between roller 178 and surface 182 on the one hand and horizontal pivot axis 111 of cam follower lever 172 at the other hand). It can be seen that an angle $\alpha$ exists between a tangent to surface 182 at the point of contact (which here coincides with the entire surface 180 as the surface is straight) and arrow R. This angle $\alpha$ is being used for controlling the relation between the speed of movement of the raising end of the raising lever 170 and the speed of movement of the detector lever.

It is possible to use a raising abutment 180 which has a curved surface 182. This introduces additional options for controlling the relation of movement of the raising lever 170 and the resulting movement of the detector lever 130.

Assuming that the angle $\alpha$ was 90°, the raising abutment 180 would be lifted at the same speed with which roller 178 would move upwardly. Using a smaller angle $\alpha$ reduces the speed of the detector lever 130 as compared to the speed of the raising lever. It is thus possible to very easily set the raising (and also lowering) speed of the detector lever 130 to desired values for a given speed of movement of the raising lever 170; cam follower lever 172 being primarily used for driving other elements of the sheet element processing machine, it is not possible to implement desired raising (and lowering) speeds of the detector lever 130 by changing the way the cam follower lever 172 is being pivoted.

During operation of the sheet element processing machine, the detector lever 130 is in its sheet receiving position for most of a revolution of cam disk 175. Only when cam follower lever 172 is pivoted in a counter clockwise direction when looking at FIGS. 9 and 14 (as a result of cam roller 174 cooperating with the raised portion of cam disk 175 which can be seen in FIG. 13 just beneath the 3 o'clock position), raising lever 170 is also pivoted in a counter clockwise direction, thereby allowing the sheet sensing end 132 with detector roller 134 to sink down until it is being stopped because of resting on the surface of a sheet to be detected (or on the upper surface of two superimposed sheets). The speed at which sheet sensing end 132 descends is set as a compromise between a speed which is sufficient for making the measurement within the time slot available, and a speed which prevents the detector roller from forming impingement marks on the sheets. Mastering the speed of the impact between the detector lever and the sheet has also a great impact on the quality of the measurement. Indeed it drastically reduces the oscillations after impact with the sheet.

After a short delay which allows oscillations in the detection system to disappear, position detector 140 provides a signal which is indicative of the distance between target 135 and detection head 141. Knowing the thickness of the sheets currently being processed, the signal allows distinguishing between a single sheet being present or two superimposed sheets being present.

Afterwards, as a result of cam follower lever 172 returning to the lower portion of cam disk 175, detector lever 130 is again lifted, and the next sheet can be advanced.

The invention claimed is:

1. A detection system for detecting double sheets being supplied to a lateral positioning device for a sheet element in a sheet element processing machine, the sheet element processing machine having a drive system including a cam disk and a cam follower lever;

the detection system comprises a detector lever mounted to be displaceable between a sheet receiving position and a sheet detection position;

the detector lever having a sheet sensing end for engagement with an upper face of the sheet element when the sheet element is in the detection position, and the detector lever having a position detector end for cooperating, when the detector lever is in the detection position, with a position detector so that the position detector generates a signal dependent on the thickness of the sheet element detected; and a raising lever configured for raising the sheet sensing end of the detector lever, the raising lever being mounted on the cam follower lever of the sheet element processing machine.

2. The detection system of claim 1, wherein the raising lever cooperates with the detector lever by abutting at a raising abutment provided on the detector lever.

3. The detection system of claim 2, wherein a tangent to the raising abutment, at the point of contact of the raising lever, is inclined with respect to a line running through the pivot axis of the cam follower lever and the point of contact is at an angle (a) which is between 5° and 80°.

4. The detection system of claim 2, wherein the raising lever cooperates with the raising abutment by means of a roller.

5. The detection system of claim 3, wherein the position detector end of the detector lever is equipped with a metal target which cooperates with a detection head of the position detector and the position detector is fitted with an inductive proximity sensor.

6. The detection system of claim 1, wherein the raising lever and the detector lever are configured to present a clearance between the raising lever and the detector lever when the detector lever is in the detection position.

7. The detection system of claim 1, further comprising a return spring operable for biasing the detector lever into the detection position of the machine.

8. A sheet element processing machine comprising a detection system according to claim 1, mounted in an introduction station upstream of a processing station of the machine.

9. The sheet element processing machine of claim 8, wherein a main lever is provided which has a first end which carries a support roller, the main lever being arranged such that at the end of the descent travel of its first end, the first end of the main lever has:

a first lowered configuration for pressing the support roller against the upper face of the sheet element so as to drive the sheet element laterally, perpendicular to a direction of advance of the sheet element through the machine; and a second raised configuration to avoid crushing the sheet element.

10. The sheet element processing machine of claim 9, further comprising a delivery wheel arranged in the machine to move the sheet element laterally to be flush against a lateral feed stop for positioning the sheet element for being contacted by the levers and for detection.

11. The sheet element processing machine of claim 9, wherein in a first configuration, on descent of the first end of the main lever, the support roller is arranged to come to rest against the upper face of a sheet element arranged on a support surface between the support roller and the delivery wheel, so as to allow gripping of the sheet element, which is driven by the delivery wheel in the direction of and as far as the lateral feed stop, which provides the lateral positioning of the sheet element against the lateral feed stop.

12. The sheet element processing machine of claim 9, further comprising:

a pusher arranged above a support surface, the pusher being configured to move from a rest position to a working position in which a sheet element arranged on the support surface is at the same height as the pusher; and a drive system performing a reciprocating movement in the lateral direction, which cooperates with the pusher only in a working position thereof such that the pusher performs a reciprocating motion between a retracted position and an advanced position, arranged to push a sheet element arranged on the support surface up to a lateral position predetermined by the advanced position.

13. The sheet element processing machine of claim 12, wherein in the first configuration, the pusher is in the rest position.

14. The sheet element processing machine of claim 13, wherein in the second configuration, the pusher is in the working position.

15. The sheet element processing machine of claim 9, wherein in a second configuration, at the end of the descent travel of the first end of the main lever, the support roller remains above the delivery wheel and at a distance from the delivery wheel, preventing the support roller from resting against the upper face of a sheet element arranged between the support roller and the delivery wheel.

* * * * *